US008079500B2

(12) United States Patent
Copplestone-Bruce

(10) Patent No.: US 8,079,500 B2
(45) Date of Patent: Dec. 20, 2011

(54) LIQUID DISPENSER

(76) Inventor: John Merlin Copplestone-Bruce, Lancashire (GB)

( * ) Notice: Subject to any disclaimer, the term of this patent is extended or adjusted under 35 U.S.C. 154(b) by 1201 days.

(21) Appl. No.: 11/807,383

(22) Filed: May 29, 2007

(65) Prior Publication Data

US 2007/0295759 A1 Dec. 27, 2007

(51) Int. Cl.
*B65D 83/00* (2006.01)
*B67D 1/00* (2006.01)
*B67D 3/00* (2006.01)

(52) U.S. Cl. ..... 222/399; 222/400.7; 222/504; 222/396; 222/61

(58) Field of Classification Search ..... 222/399, 222/400.7, 504, 480, 481.5, 396, 397, 61, 222/53

See application file for complete search history.

(56) References Cited

U.S. PATENT DOCUMENTS

| | | | | |
|---|---|---|---|---|
| 3,420,418 | A * | 1/1969 | Rousset et al. | 222/399 |
| 4,473,174 | A | 9/1984 | Heuser | |
| 4,595,121 | A | 6/1986 | Schultz | |
| 4,982,879 | A | 1/1991 | Corrado et al. | |
| 5,022,565 | A * | 6/1991 | Sturman et al. | 222/396 |
| 5,139,179 | A * | 8/1992 | Cecil | 222/399 |
| 5,180,081 | A * | 1/1993 | McCann | 222/23 |
| 5,443,186 | A * | 8/1995 | Grill | 222/396 |
| 5,586,695 | A * | 12/1996 | Labus et al. | 222/396 |
| 5,772,075 | A * | 6/1998 | Ash et al. | 222/1 |
| 6,036,054 | A * | 3/2000 | Grill | 222/3 |
| 6,651,852 | B2 * | 11/2003 | Arellano | 222/399 |

FOREIGN PATENT DOCUMENTS

| | | | |
|---|---|---|---|
| DE | 516046 | C | 1/1931 |
| DE | 524397 | C | 5/1931 |
| DE | 615553 | C | 7/1935 |
| DE | 681090 | | 9/1939 |
| DE | 29823474 | U1 | 7/1999 |
| GB | 1439559 | | 10/1974 |
| WO | WO02/066363 | | 8/2002 |
| WO | WO 2004/050537 | A2 | 6/2004 |

OTHER PUBLICATIONS

New Zealand Examination Report, May 4, 2010.

* cited by examiner

*Primary Examiner* — Kevin P Shaver
*Assistant Examiner* — Stephanie E Williams
(74) *Attorney, Agent, or Firm* — Maier & Maier, PLLC

(57) ABSTRACT

A liquid dispenser for dispensing liquid from a container, includes an intake pipe to receive liquid from the container, an outlet to dispense liquid, a pressure supply mechanism to supply pressurized fluid to the container at a first pressure, and a dispensing mechanism. The dispensing mechanism is operable to dispense liquid from the container by reducing the pressure in the container to a second pressure, connecting the intake pipe to the outlet to dispense fluid from the container, and subsequently increasing the pressure in the container to the first pressure.

17 Claims, 15 Drawing Sheets

10
11
12
13
14

50
50a
52
29
55
57
59

52
50a
29
50
55
57
59

53
51a
51
56
58
60

53
58
51
56
51a
60

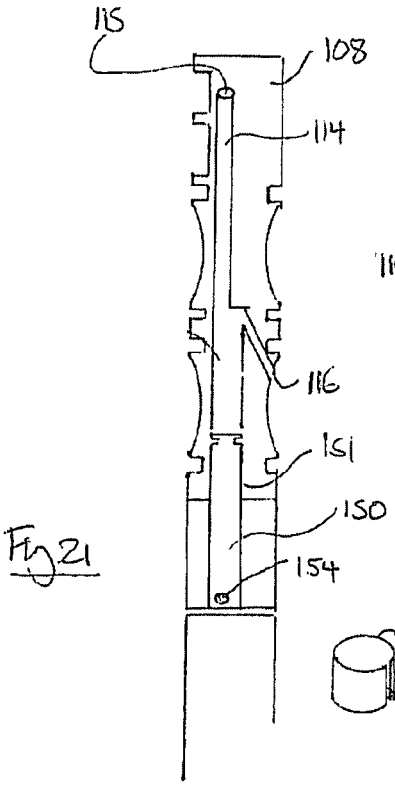
Fig 21
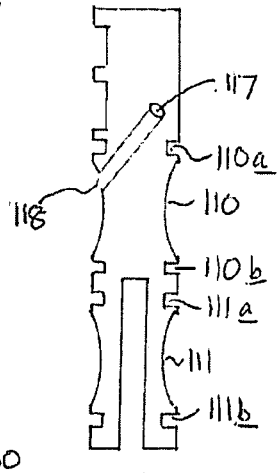
Fig 22
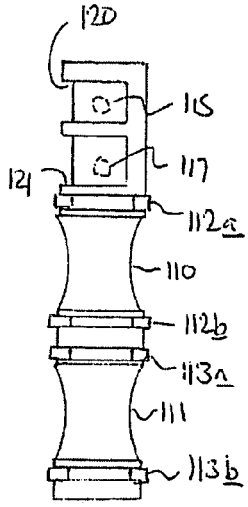
Fig 23
Fig 24
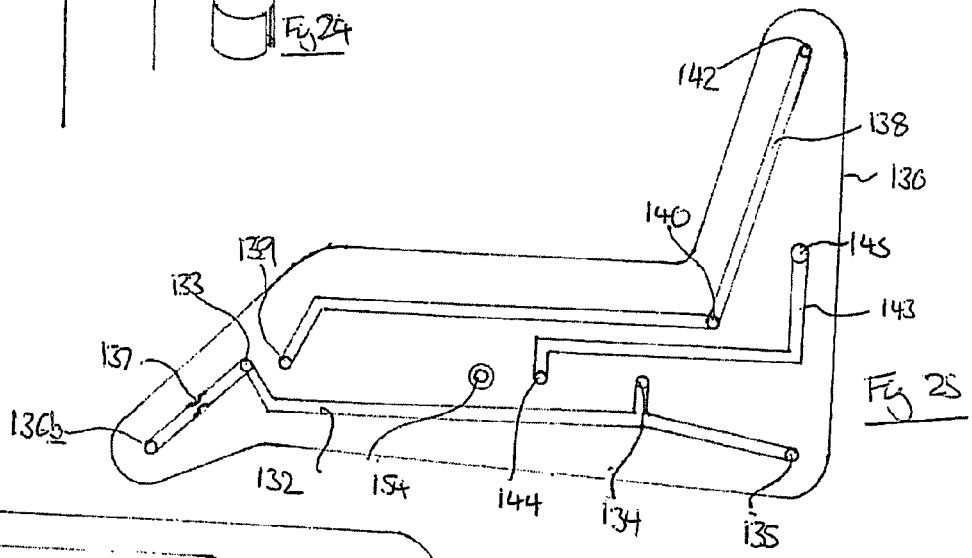
Fig 25
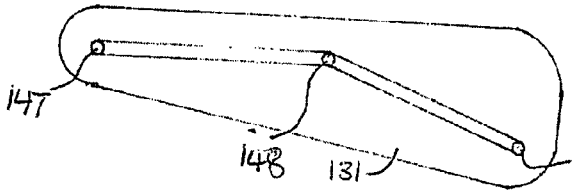
Fig 26

LIQUID DISPENSER

CROSS REFERENCE TO RELATED APPLICATION

This application claims the priority of United Kingdom Patent Application No. GB 0610491.3 filed on May 26, 2006, the disclosure of which is incorporated herein by reference for all purposes.

FIELD OF THE INVENTION

This invention relates to a dispenser, primarily for liquids but possibly for gas or composite materials.

BACKGROUND OF THE INVENTION

With many liquids, including for example carbonated drinks and wine, when the container is opened the unused or undrunk contents can degrade. For example, carbonated drinks may go flat, whilst wine which has been opened with oxidise. The problem is not only limited to drinks, but may apply to other liquids where contact with air or avoidance of contamination might be desirable. For example, where a liquid is flammable, it may be desirable to fill the remainder of the container with an inert gas to prevent combustion. Where the liquid is, for example, medical use, it would be extremely desirable to prevent contamination.

It is known to keep liquids in containers where the pressure and/or composition of the gas in the head space of the container is appropriately controlled. Thus, it is for example known to keep open bottles of wine under an inert atmosphere and similarly with flammable liquids. However, these have the problem that the gas must be released to dispense the liquid. Similarly, if the pressure in the container is too high then this may cause problems when the liquid is dispensed, for example, by causing a carbonated drink to foam undesirably.

An aim of the present invention is to reduce or overcome one or more of the above problems.

SUMMARY OF THE INVENTION

According to the present invention, we provide a liquid dispenser for dispensing liquid from a container, liquid dispenser comprising an intake pipe to receive liquid from the container, an outlet to dispense liquid a pressure supply mechanism to supply pressurised fluid to a head space of the container at a first pressure, and a dispensing mechanism, the dispensing mechanism being operable to dispense liquid from the container by reducing the pressure in the head space of the container to a second pressure, connecting the intake pipe to the outlet to dispense fluid from the container, and subsequently increasing the pressure in the head space of the container to the first pressure.

The dispensing mechanism may be further operable, when the intake pipe is connected to the outlet to connect the head space of the container to the pressure supply mechanism to maintain the pressure in the head space in the container at about the second pressure while the liquid is dispensed.

The dispensing mechanism may comprise a valve element movable between a first position, to connect the head space of the container to the pressure supply mechanism, and a second position to connect the head space of the container to a vent to reduce the pressure in the head space of the container to the second pressure.

The valve element may be movable to a third position to connect the pressure supply mechanism to the head space of the container via a restricter to maintain the pressure in the head space of the container at about the second pressure while liquid is being dispensed.

The valve element may further comprise a fluid passage to connect the intake pipe to the outlet when the valve element is in its third position.

The valve element may be rotatable between its positions.

The valve element may be linearly moveable between its positions.

The dispenser may comprise a closer element moveable to connect the intake pipe to the outlet when the valve element is in its second position.

The liquid dispenser may further comprise a biasing element operable to urge the valve element towards its first position.

The liquid dispenser may further comprise a demand mechanism of operable to move the valve element from its first position.

The demand mechanism may comprise a fluid pressure operated actuator, and a control operable to supply pressurised fluid to the actuator to move the valve element from its first position to its second position.

The demand mechanism may be operable to move the valve element from the second position to the third position when the pressure in the head space of the container has reduced.

The demand mechanism may comprise a secondary valve to connect the actuator to the pressure supply mechanism when the control is operated and the pressure in the head space of the container has fallen to the second pressure.

The actuator may comprise a first actuation element to rotate the valve element from its first position to its second position when connected to the pressure supply mechanism, and a second actuation element to rotate the valve element to its third position when connected to the pressure supply mechanism.

The liquid dispenser may further comprise a liquid engagement part to engage a mouth of the container and to provide a pressure-tight seal therewith.

The liquid dispenser may comprise a pressure supply connector to connect to the pressure supply mechanism to a source of pressurised fluid.

The liquid dispenser may comprise a container having a first part having the pressure supply mechanism and a dispensing mechanism, and a second part to receive the container, the first part and second part being releasably connectable.

These and further features and advantages of the present invention will become apparent from the following detailed description, wherein reference is made to the figures in the accompanying drawings.

BRIEF DESCRIPTION OF THE DRAWINGS

An embodiment of the invention will now be described by way of example only with reference to the accompanying drawings, wherein:

FIG. 21 is a sectional view through a valve element of FIG. 20, FIG. 22 is a further sectional view through the valve element of FIG. 21, FIG. 23 is a side view of the valve elements of FIG. 21 and 22, FIG. 24 is a perspective view of a clip of the valve element of FIG. 23, FIG. 25 is a sectional view of a first supply manifold of the valve assembly of FIG. 20, FIG. 26 is a sectional view through a second supply manifold of FIG. 20.

DETAILED DESCRIPTION OF PREFERRED EMBODIMENTS

Figure 1:
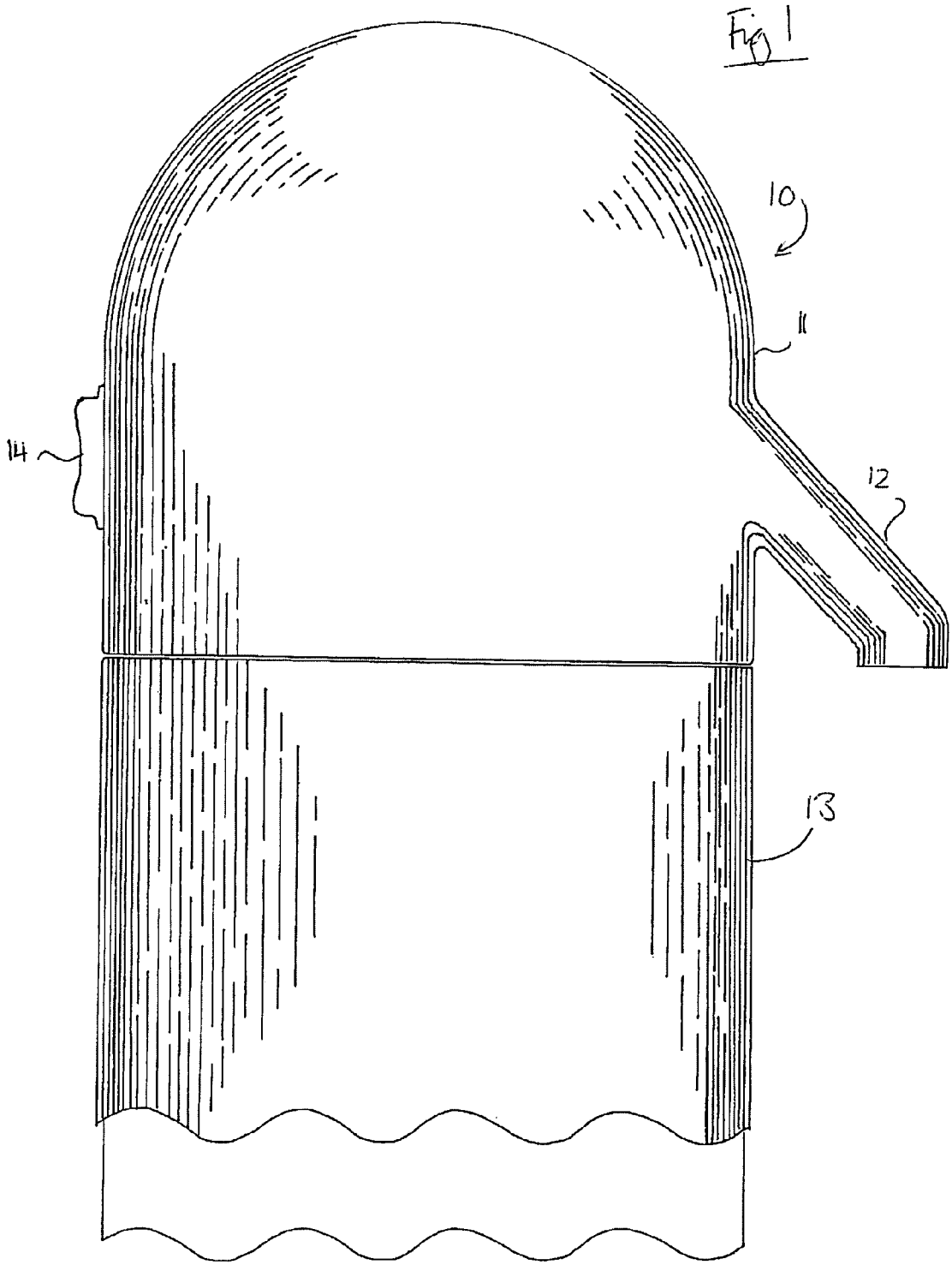
FIG. 1 is an external view of a liquid dispenser embodying the present invention.

Referring now to FIG. 1, a liquid dispenser embodying the present invention is shown generally at 10, comprising a first part 11 having an outlet spout 12, a second part 13 to hold a container holding the liquid for dispensing, and a button 14 which may be present to dispense liquid from a container.

Figure 2:
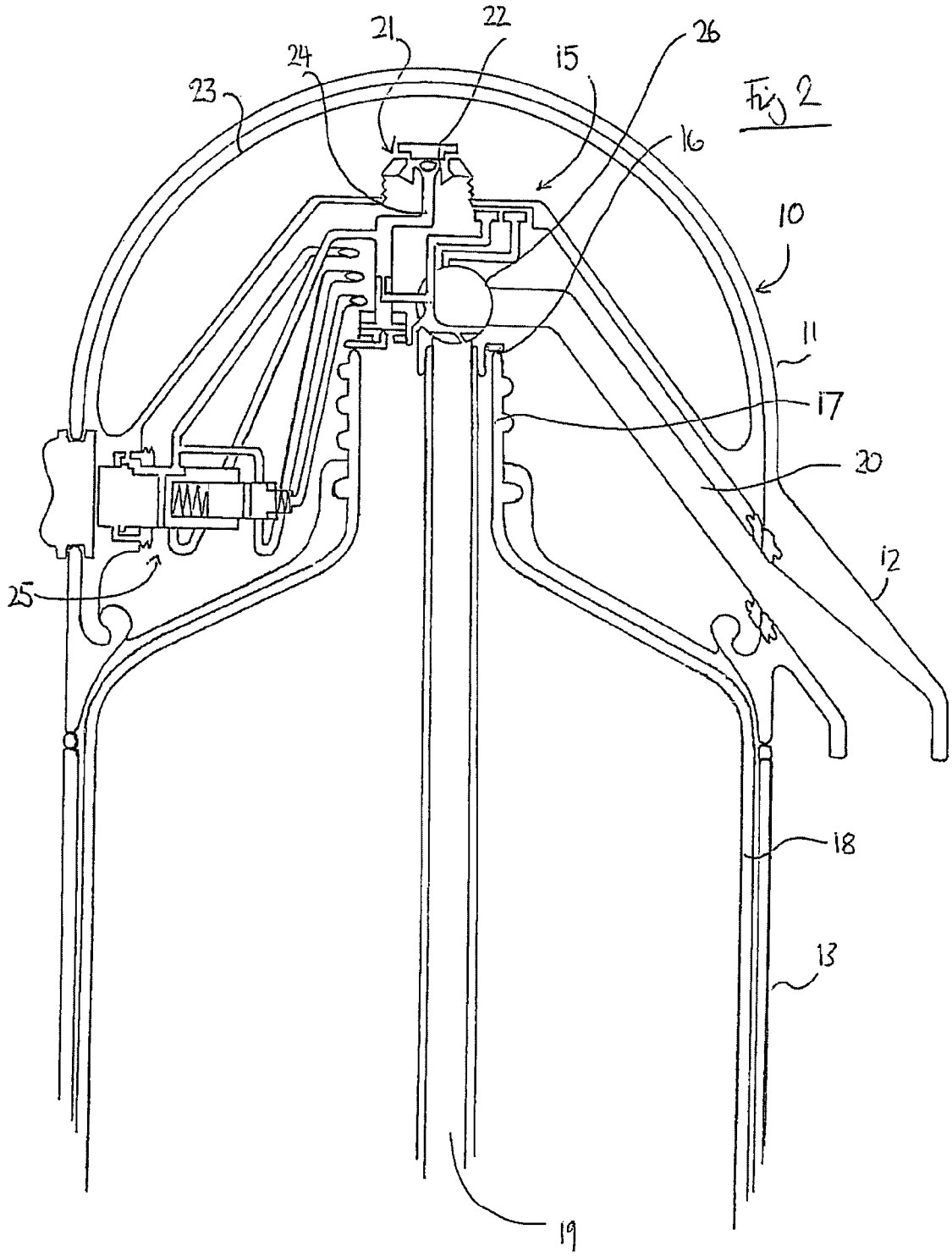
FIG. 2 is a sectional view through the dispenser of FIG. 1.

Referring now to FIG. 2, a section through the dispenser 10 is shown. In particular, the dispenser comprises a dispensing mechanism generally shown at 15 which is located within the first part 11 of the dispenser 10. The first part 11 has a container engagement part 16 to provide a sealing engagement with a mouth part 17 of a container 18 received in the second section 13 of the dispenser 10. An intake pipe 19 extends from the dispensing mechanism 15 downwardly into the container 18. An outlet is provided shown at 20 which is in flow communication with the spout 12 to direct liquid outwardly and in a downward direction so that it can be dispensed into a suitable receptacle.

To provide pressurised fluid to the head space of the container 18, a pressure supply mechanism is shown generally at 21. A nozzle 22 engages a supply of pressurised fluid, in this example a gas canister 23. A fluid pressure supply channel 24 supplies pressure from the gas canister 23 to a demand mechanism generally shown at 25 and a valve element 26 which provides part of the dispensing mechanism 15 as discussed below in more detail.

Figure 3:
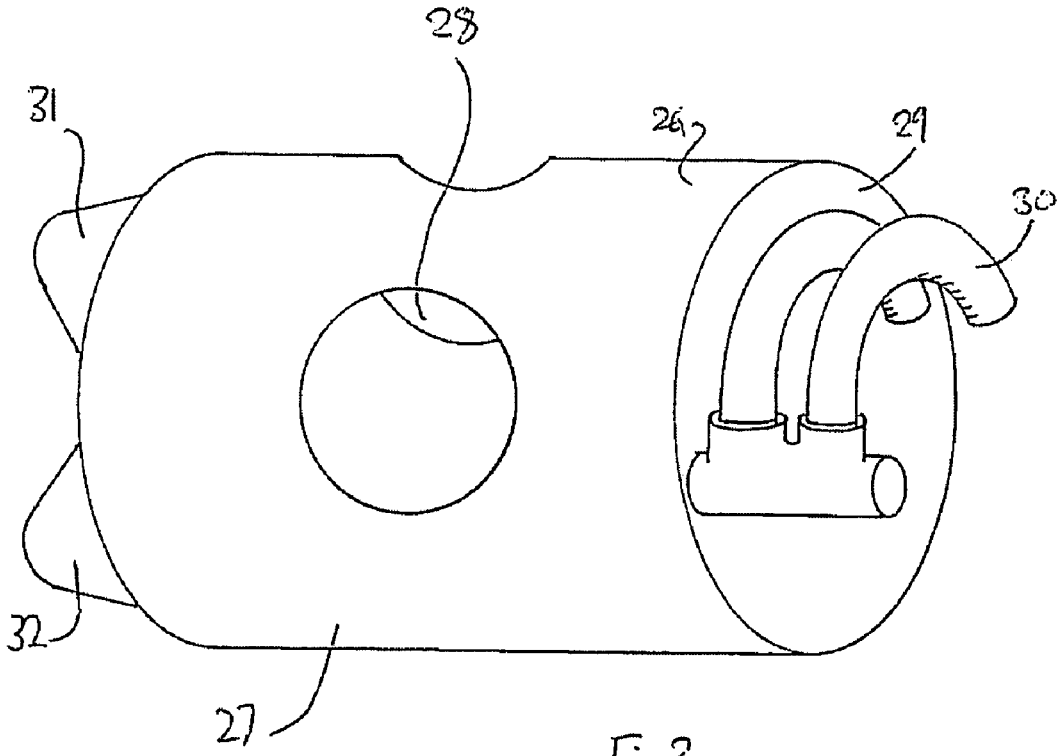
FIG. 3 is a perspective view of a valve element of the liquid dispenser of FIG. 1.
Figure 4:
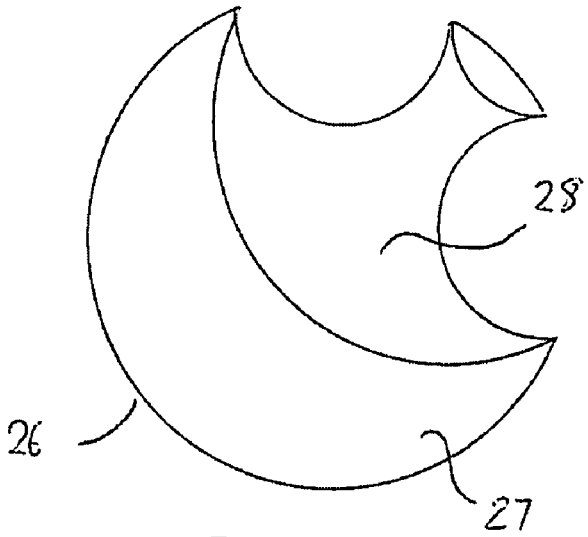
FIG. 4 is a section through the valve element of FIG. 3.

The valve element 26 as shown in detail in FIGS. 3 and 4 comprises a generally cylindrical body 27 having a fluid passage 28 therethrough. When the valve element 26 is in the correct orientation, the fluid passage connects the intake pipe 19 to the outlet 20 to permit the liquid to be dispensed. The valve element 26 is connected to a pair of actuator rods shown at 29, 30 to cause the valve body to move, as will be discussed in more detail below, and is also provided with a pair of projections 31, 32 to engage a bias element to bias the valve element 26 to a first position.

Figure 5:
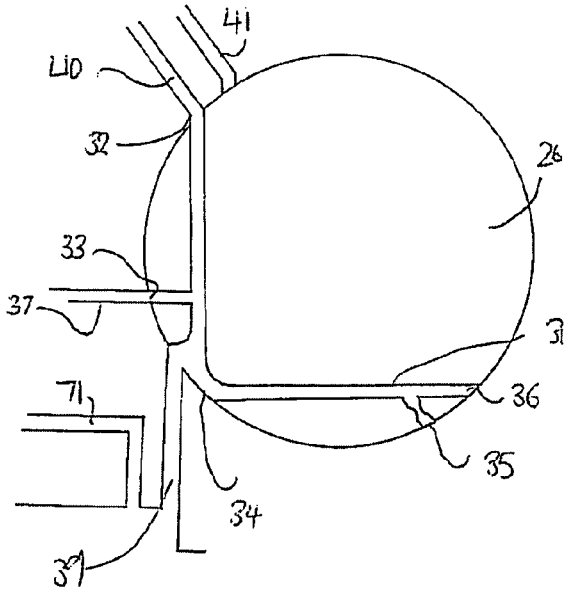
FIG. 5 is a further section through the valve element of FIG. 3.
Figure 6:
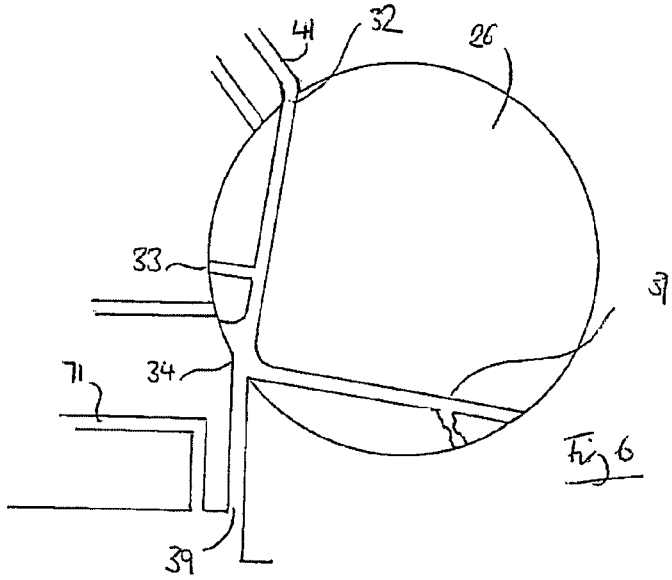
FIG. 6 is a similar view to that of FIG. 5 shows the valve element in a further position.
Figure 7:
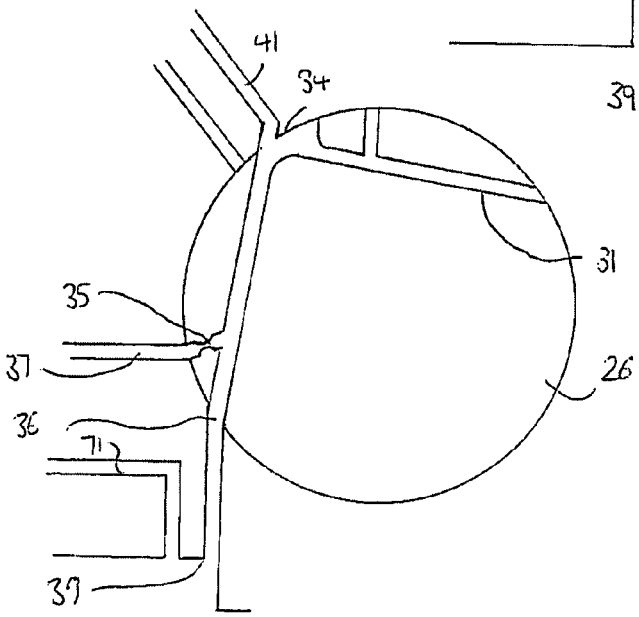
FIG. 7 is a view similar to that of FIG. 5 showing the valve element in a still further position.

As shown in more detail in FIGS. 5 to 7, the valve element 26 comprises a passage generally shown at 31 to supply fluid under pressure to and release when under pressure from the container 18.

Figure 8A:
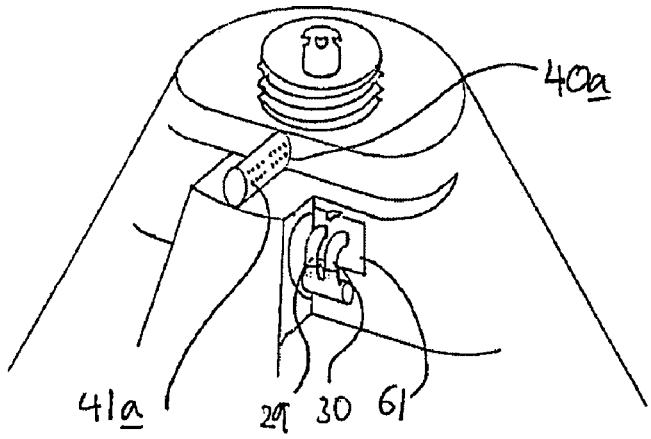
FIG. 8*a* is a view on a larger scale of a further part of the dispenser of FIG. 1.
Figure 8B:
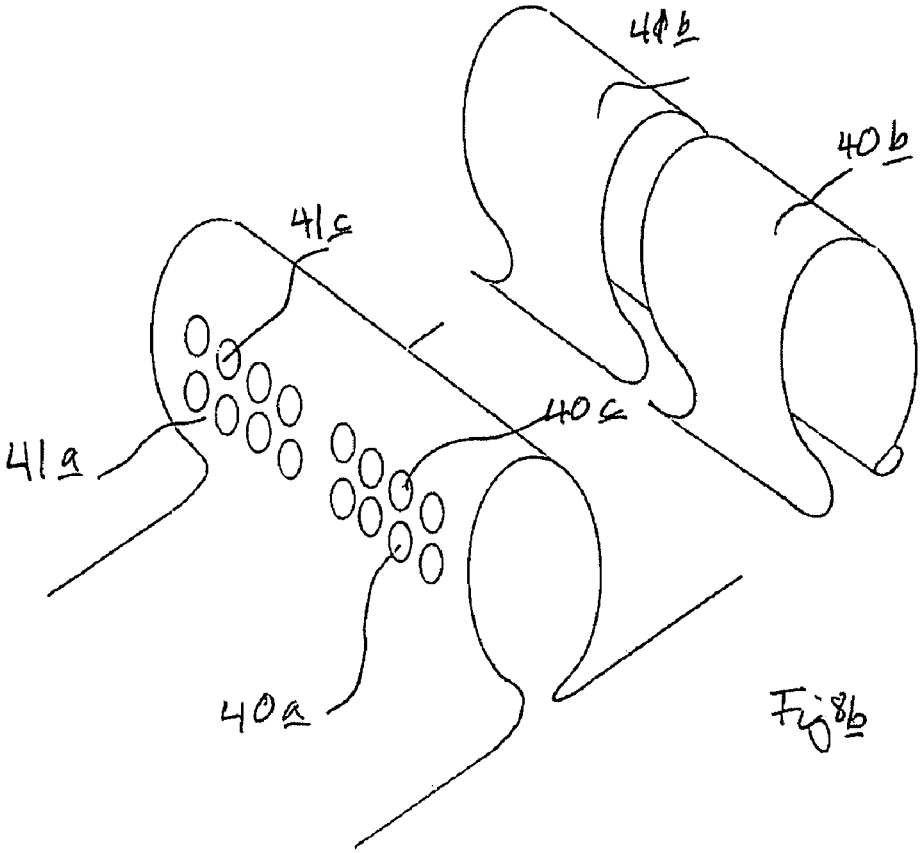
FIG. 8*b* is a view of part of the view of FIG. 8*a*.

Referring now to FIGS. 5 to 7, the passage 31 is provided with a vent, connection 32, a gas supply inlet 33, a first container connection 34, a restricter inlet 35 and a second container connection 36. A fluid pressure supply connection 37 extends from a pressure regulator 38, discussed in more detail below, to supply pressurised fluid from the pressure supply mechanism 21. A container connection passage 39 extends from the valve element 26 to the container. A first vent outlet 40 extends to a high pressure vent shown at 40*a* in FIG. 8*a*, and a second vent outlet 41 extends to a low pressure vent shown at 41*a* in FIG. 8*a*. As shown in FIG. 8*b* each vent is covered by a corresponding clip 40*b*, 41*b* which obstructs the holes 40*c*, 41*c* of the respective vent 40*a*, 41*a*. The pressure at which each vent opens is set by choosing an appropriate strength clip 40*b*, 41*b*, thus permitting the first pressure and second pressure to be selected depending on the liquid to be disposed.

Figure 9:
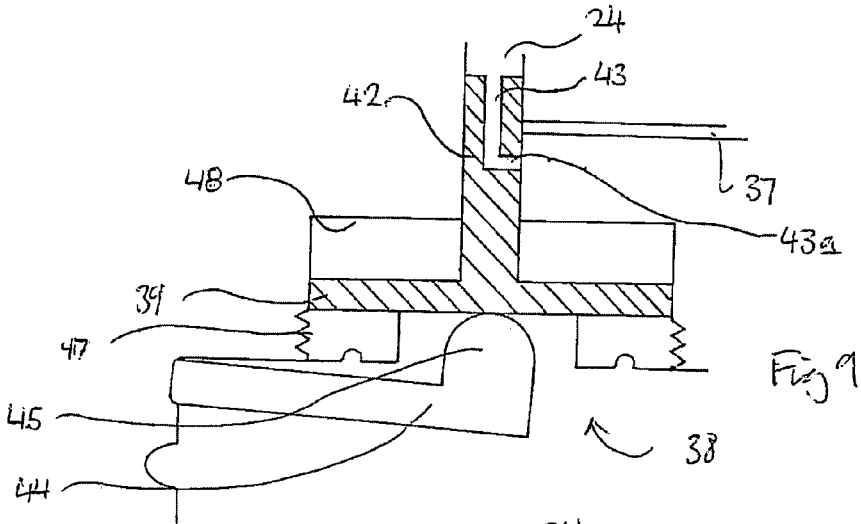
FIG. 9 is a diagrammatic view of a pressure regulator of the dispenser of FIG. 1.

When the valve element 26 is in its first position as illustrated in FIG. 5, the fluid pressure supply passage is connected via inlet 33 and first container connection 34 to container connection passage 39. Pressurised fluid is then supplied from passage 24 via the pressure regulator 38, as shown in FIG. 9, and valve element 26 to the container to maintain the pressure in the head space above the liquid in the container at a first relatively high pressure. The pressure regulator 38 acts to maintain the pressure in the container at this first pressure as will be described hereinafter, and in this position the container is consequently maintained pressurised, and with the desired atmosphere if being used. The connection of the vent connection 32 to the first vent outlet 40 and high pressure vent 40*a* ensures that if the pressure in the container builds up beyond a safe level, for whatever reason, it will be vented through the high pressure vent 40*a*.

When it is desired to dispense liquid from the container, the valve element 26 is rotated to its second position as shown in FIG. 6. In its position, the inlet 33 is moved out of communication with the fluid pressure supply connection 37, and vent connection 32 is moved into communication with the second vent outlet 41. Because connection 34 is an extended opening, it remains in fluid communication with the passage 39 to the container. Consequently, the fluid under pressure in the head space of the container will be vented through the container passage 39, passage 31, second vent outlet 41 and low pressure vent 41*a* until the pressure within the head space of the container falls to a second, lower pressure which may be adjusted by varying the characteristics of the low pressure vent 41*a*.

When the valve element 26 is rotated to its third position as shown in FIG. 7 the outlet 36 is brought into communication with the connection passage 39 and restricter inlet 35 is brought into communication with the fluid pressure of supply connection 37. Container connection 34 moves into communication with the second vent outlet 41. In this orientation, the fluid passage 28 is also brought into communication with the inlet pipe 19 and outlet 20. The second pressure is selected such that liquid is urged out of the container 18, up the intake pipe 19 and through the valve body 26 to the outlet 20 and spout 12, and so the second pressure should accordingly be higher than the external ambient pressure around the liquid dispenser 10. As liquid is being dispensed from the container 18 the volume in the head space of the container 18 will increase and the restricter inlet 35 thus allows pressure to bleed through from the fluid pressure supply passage 37 through the container connection 39 into the head space of the container 18. The connection to the second vent outlet 41 ensures that the pressure in the container will be maintained at the second pressure while the restriction inlet 35 ensures that there will be no sudden pressure increase.

Once this liquid dispensing has ceased, the valve element 26 will return to its first position as shown in FIG. 5 and the pressure in the head space of the container 18 will be returned to the first, relatively high, pressure.

The pressure regulator 38 will now be discussed in more detail with reference to FIGS. 9 to 12*b*. The pressure regulator is connected to fluid pressure inlet passage 24, leading to the nozzle 22, and to fluid pressure supply passage 37 leading to the valve element 26. The pressure regulator 38 comprises a piston 39 which is movable between a collar 47 and an end wall 48. A rod 42 is attached to the piston 39 and movable within an end part of passage 24. A bore 43 within the rod 42 is in flow communication with the fluid pressure supply passage 24 and has a side arm 43*a* connectable to fluid pressure supply passage 37. A displacement lever 44 is mounted below the piston 39 and a projection 45 is located on the lever 44 to act on the piston 39. The lever 44 is located immediately above the container engagement part 16, in this case an internal thread to receive an externally threaded portion of a mouth part of the container 18. As illustrated in FIG. 9, when there is no container engaged with the connection part, there is no upward force on the lever 44 and the piston 39 remains at its lowermost position adjacent the collar 47. As the arm 43*a* is not in communication with the fluid pressure supply passage 37, there is no supply of fluid under pressure from the fluid supply passage 24 to the valve element 26. If there is fluid under pressure in supply passage 24 it will act on the end of rod 42 to maintain the piston 39 in the position shown in FIG. 9; and accordingly no fluid under pressure will be released when no container is present.

Figure 10:
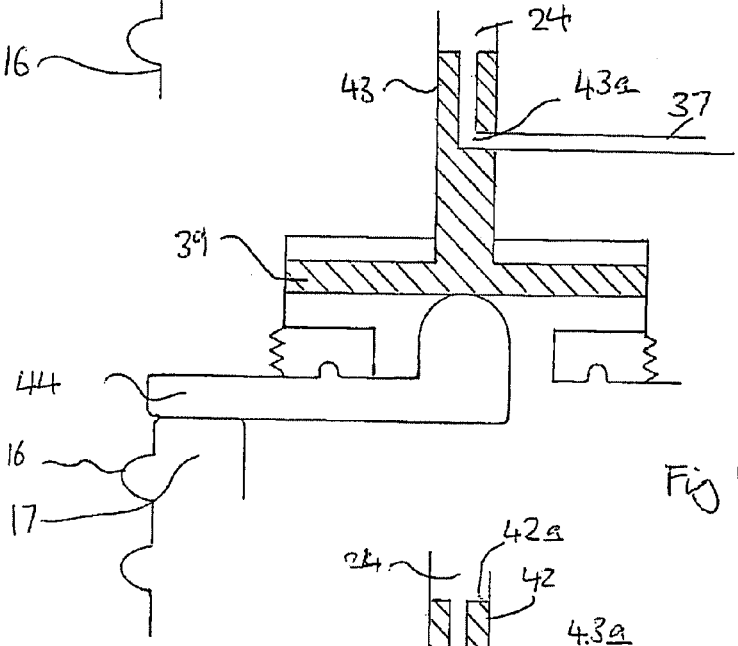
FIG. 10 is a view of the pressure regulator of FIG. 9 in a further position.
Figure 11:
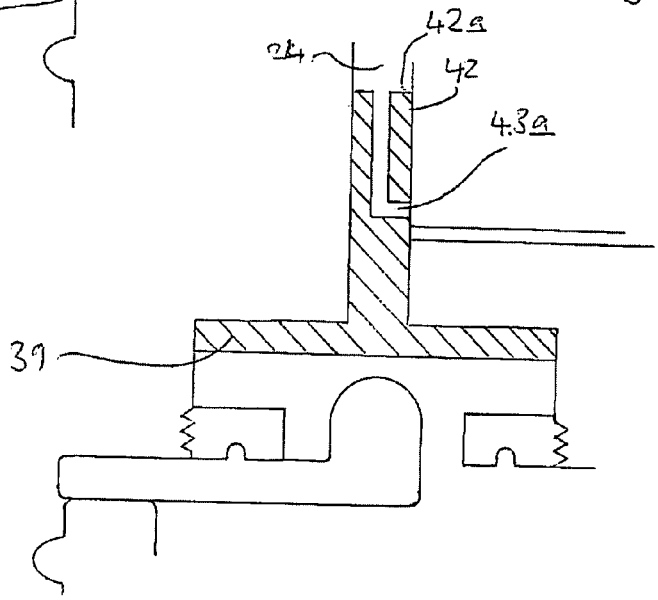
FIG. 11 is a view of the pressure regulator of FIG. 9 in a still further position.

When a container is introduced into the dispenser, as illustrated in FIG. 10 a mouth part 17 is introduced into the connecting means 16 and acts on the lever 44, forcing it upwardly as shown such that the projection 45 pushes the piston 39 upwardly to bring the passage 43*a* into communication with the fluid pressure supply passage 37. It thus permits pressurised fluid to flow from passage 24 to the valve element 26. As the valve element 26 will be in its first position as shown in FIG. 5, fluid pressure will be supplied to the head space of the container 18. While the pressure in the passage 24 is higher than that in the interior of the container 18, the piston 39 will remain in the position as shown in FIG. 10. However, when the pressure within the container 18 acting on the lower face of the piston 39 produces a force greater than that exerted on the end face 42*a* of the rod 42 by the pressure in the passage 24, the piston 39 and rod 42 will hence be forced upwardly, moving the passage 43*a* out of communication with passage 37 and thus cutting off the supply pressure from passage 24 to the valve element 26 as shown in FIG. 11. The first pressure is thus set by the relative size of the piston 39 and rod 42 and may be adjusted accordingly depending on the required pressure within the container 18. The pressure in the container 18 may also depend on the pressure set by the high pressure vent 40*a* thus providing a number of ways in which the desired first pressure can be adjusted. It will be apparent that when the pressure within the container 18 falls, the piston 39 will be urged from the position in FIG. 11 back down to the position as shown in FIG. 10 to allow pressurised fluid to be supplied to the container 18 one again.

To adapt the size of the piston 39, for example where different pressures are required, it will be apparent that the diameter of space within the collar 47 may be reduced by located a sleeve between the piston 39 and the collar 47.

Figure 12A:
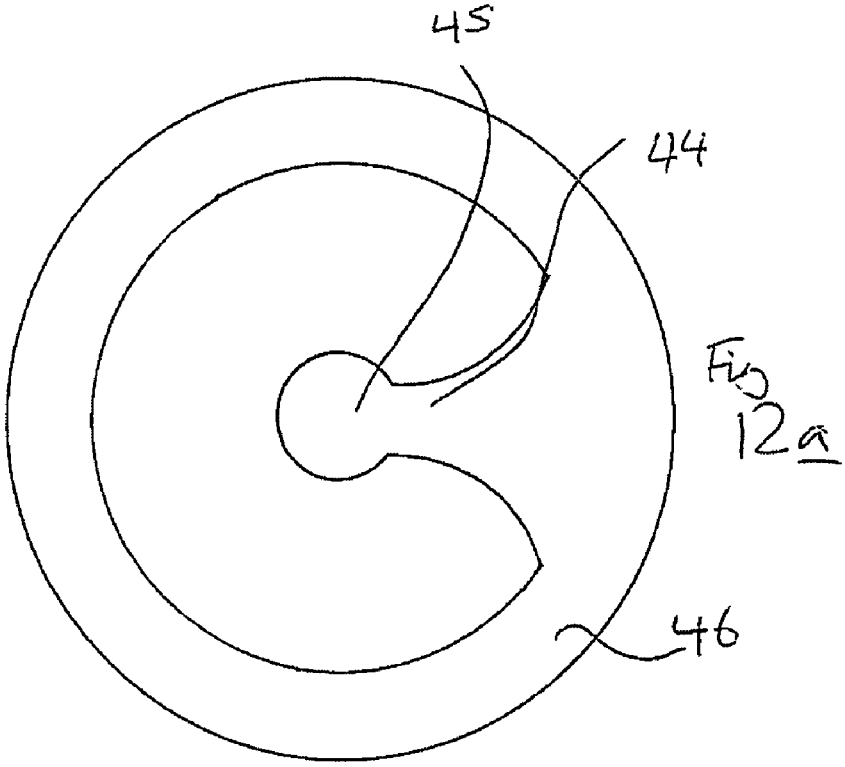
FIG. 12*a* is a plan view of part of the pressure regulator of FIG. 9.
Figure 12B:
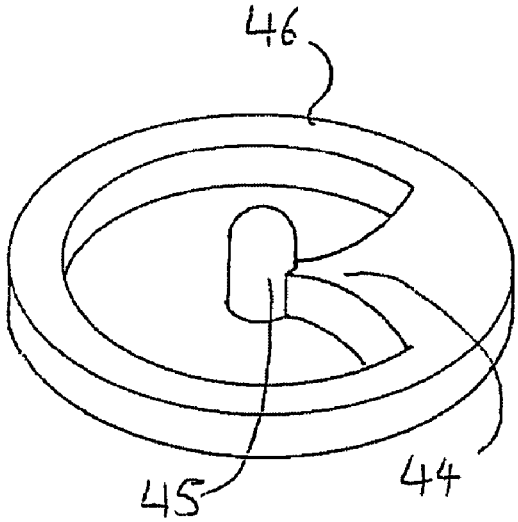
FIG. 12*b* is a perspective view of the part of FIG. 12*a*.

As shown in FIGS. 12*a* and 12*b* the lever 44 comprises an arm supported by and extending inwardly from an annular support 46 which may be located above the connection means 16 and indeed provide a seal for abutment by the container mouth part 17. The projection 45 is located generally centrally of the annular outer part 46 supported by the lever 44.

Figure 17:
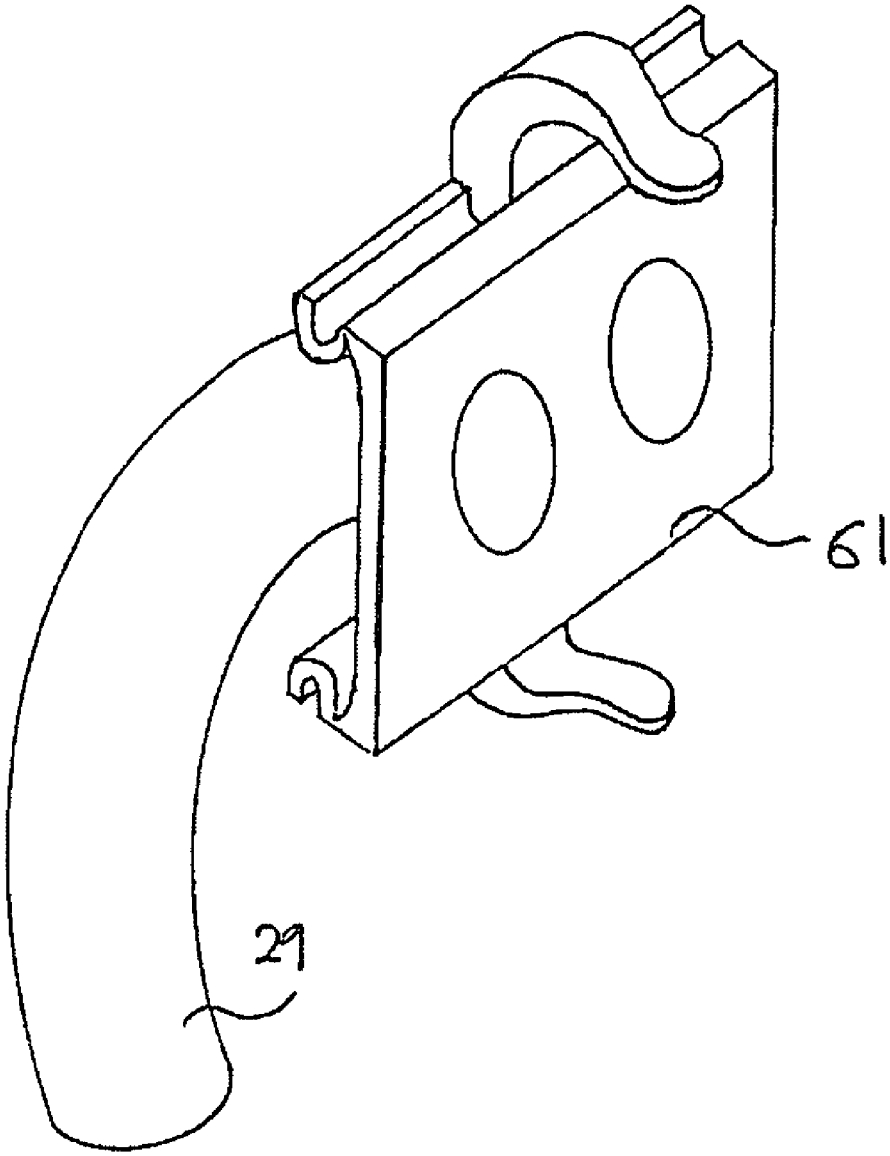
FIG. 17 shows a part of the view of FIG. 8*a* in more detail.

Referring back now to FIGS. 5 to 7, it will be appreciated that it is necessary to rotate the valve element 26 through two angles, from the first position to the second position and from the second position to the third. This may be achieved by having an actuator which is controllably movable between the positions, but in the present example is achieved by having a first actuation element 29 and second actuation element 30. These elements are shown in more detail in FIGS. 13, 14, 15, and 16. As shown in these figures, each of the actuation elements 29, 30 comprises a curved rod 50, 51 which is movable within a sleeve 52, 53, mounted in an arcuate passage 55, 56. A piston 57, 58 is located at the end of the passage 55, 56 and is movable therein in response to the supply of pressure on a corresponding control line 59, 60. It can be apparent that the actuating elements 29, 30 are essentially identical and vary only in the size of the sleeve 52, 53. The respective pistons 57, 58 moves within the passage 55, 56 as far as the end of the sleeve 52, 53, and in doing so pushes the corresponding rod 50, 51. A head part 50*a*, 51*a* of the rod 50, 51 is connected to a common plate generally shown at 61 in FIGS. 17 and 8*a*.

Figures 13, 14, 15, 16:
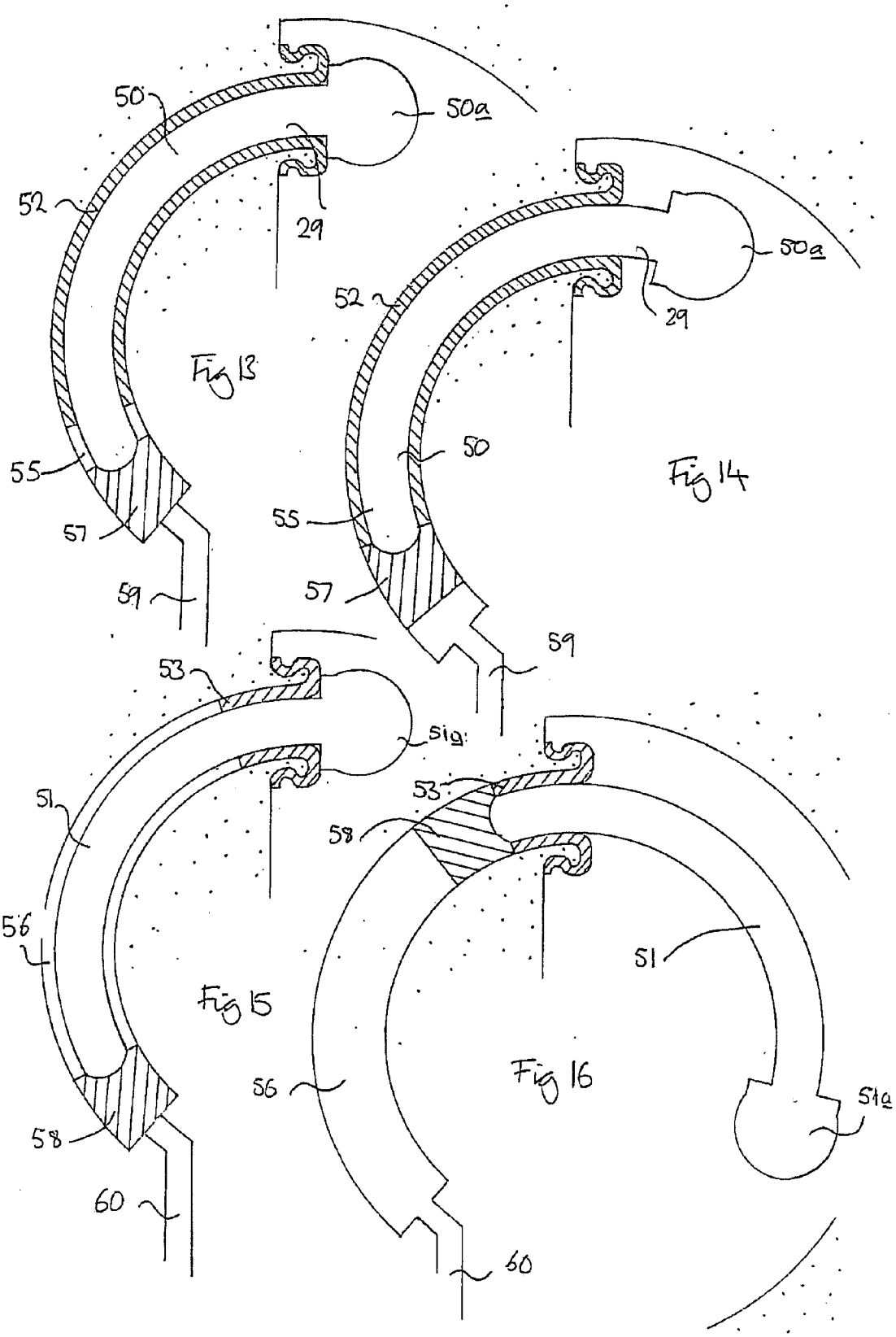
FIG. 13 is a section through a first actuating element as shown in FIG. 8.
FIG. 14 shows the actuating element of FIG. 13 in an extended position.
FIG. 15 is a section through a further actuating element.
FIG. 16 shows the actuating element of FIG. 15 in an extended position.

Consequently, it will be seen from FIGS. 14 and 16 that operating the respective actuation element 29, 30 will cause corresponding rods 50, 51 to extend by different amounts, and thus rotate the valve element 26 through a first angle and a second angle.

Figure 18:
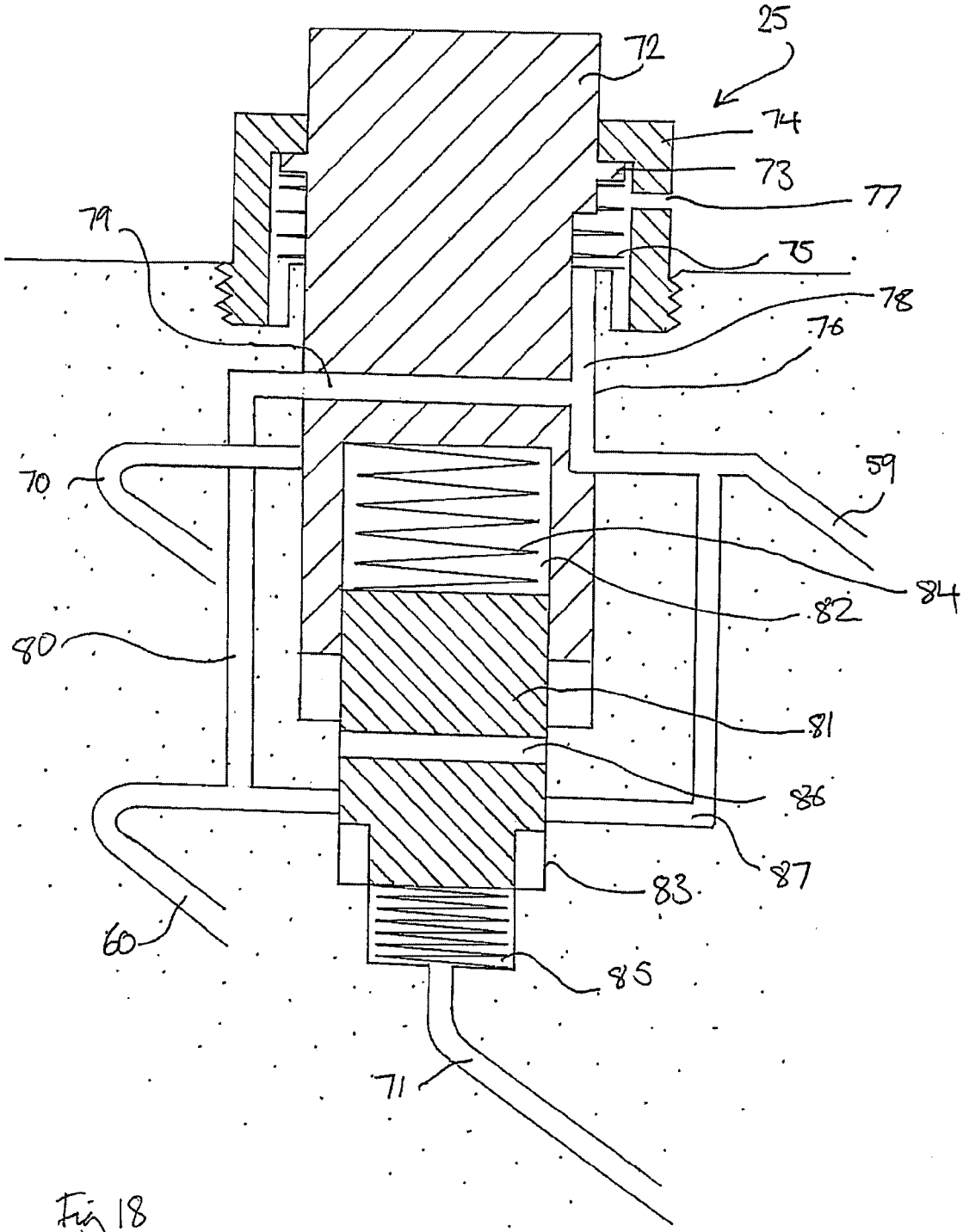
FIG. 18 is a sectional view through a demand mechanism of the dispenser of FIG. 1.

To provide the successive operation of the actuating elements 29, 30 in response to the button 14 being depressed to dispense liquid as a consequence change in pressure within the container 18, the demand mechanism 25 is provided as shown in more detail in FIG. 18. The demand mechanism 25 is connected to the fluid pressure supply passage 24 via passage 70, and is connected to the first actuation element 29 through passage 59 and to the second actuation element 30 via passage 60. A pilot passage 71 is in flow communication with the head space of the container 18, for example as shown in FIGS. 5 to 7.

The demand mechanism comprises a first push element 72. The first push element 72 has an outward flange 73 which engages a collar 74 to hold the first push element 72 in place. A spring 75 acts on the flange 73 to urge the push element 72 in an upwards direction as shown in FIG. 18. The first push element 72 is movable within a bore 76, which is in flow communication with a vent 77 through a gallery 78 provided in the side of the push element 72. The push element 72 further has a through passage 79 which is in flow communication with the gallery 78. When the push element 72 is in its biased position, the through passage 79 is in flow communication through line 80 with the passage 60 to the second actuating element 30. The passage 59 to the first actuation element 29 is in flow communication with the gallery. Accordingly, both of actuation elements 29, 30 are connected to atmosphere when the push element 72 is in its biased position as shown in FIG. 18.

The demand mechanism 25 further comprises a second push element 81. The first push element is partly received within a counter bore 82 within the lower end of the first push element 72, and partly within a bore 83. A first spring 84 is located within the counter bore 82 and acts on the second push element 81 to urge it downwardly as shown in FIG. 18. A second, spring 85 is located within the bore 83 and acts to urge the second push element 81 in an upwards direction. The pilot passage 71 is in flow communication with the bore 83. A through passage 86 is provided in the second push element 81 which is operable to bring the actuation supply passages 59, 60 into flow communication via by-pass line 87 when the second push element 81 is moved sufficiently downwardly as described herebelow.

Accordingly, when the pressure within the head space for the container 18 is at its first pressure and liquid dispensing is not required, the first push element 72 is in its biased position as shown, connecting the actuation elements, via passages 60, 59 to atmosphere, such that there is no force acting on the valve element 26. The internal pressure of the container 18 acts through pilot passage 71 to urge the second push element 81 to its position as shown in FIG. 18.

When it is desired to dispense liquid, the button 14 is depressed. This will urge the first push element 72 downwardly against the resistance of the spring 75. The flange 73 will be moved downwardly sufficiently to cut off vent 77, thus disconnecting the gallery 78 from atmosphere. When the push element 72 is moved sufficiently, the flow passage 79 will be brought into communication with the flow pressure supply 70, supplying fluid under pressure via the gallery 78 to the first actuator supply passage 59. Flow pressure will then be supplied to the first actuation element 29 causing the valve element 26 to rotate from the first position to the second position as described hereinbefore. This will cause the pressure within the container 18 to begin to fall towards the second, lower pressure.

Although the first push element 72 will have been displaced in response to the button 14 being pressed, the second push element 81 will be held in its position as shown in figure as the upward force of the second spring 85 and the pressure from the pilot passage 71. As the pressure within the container 18 falls, the upward force generated by the fluid pressure from the pilot passage 71 will gradually fall until the force generated by the pressure and the second spring 85 is overcome by the force generated by the first spring 84. The second push element 81 will move downwardly, bringing the through passage 86 into flow communication with by-pass line 87. This will connect the second actuator supply passage 60 to the first actuator supply passage 59 and consequently through passage 79 and 70 to the fluid pressure supply passage 24. Accordingly, fluid pressure will be supplied to the second actuation element 30, causing the valve element 26 to rotate from its second position to its third position as discussed hereinbefore, allowing liquid to be forced out of the container through intake pipe 19, valve element 26 and outlet 20.

When sufficient liquid has been dispensed, the button 14 will be released. The effect of the spring 75, second spring 85 and first spring 84 will be to urge the push elements back to their starting position as shown in FIG. 18. Consequently, the fluid pressure supply line 70 will be cut off and the actuator supply passages 59, 60 will once again be connected to atmosphere through vent 77. In the absence of any pressure supply to the actuation elements 29, 30 the biasing means will act to urge the valve element 26 back to its first position as described hereinbefore, thus causing the pressure in the head space of the container 18 to be increased to the first pressure by operation of the pressure regulator 38 as described hereinbefore.

Figure 19:
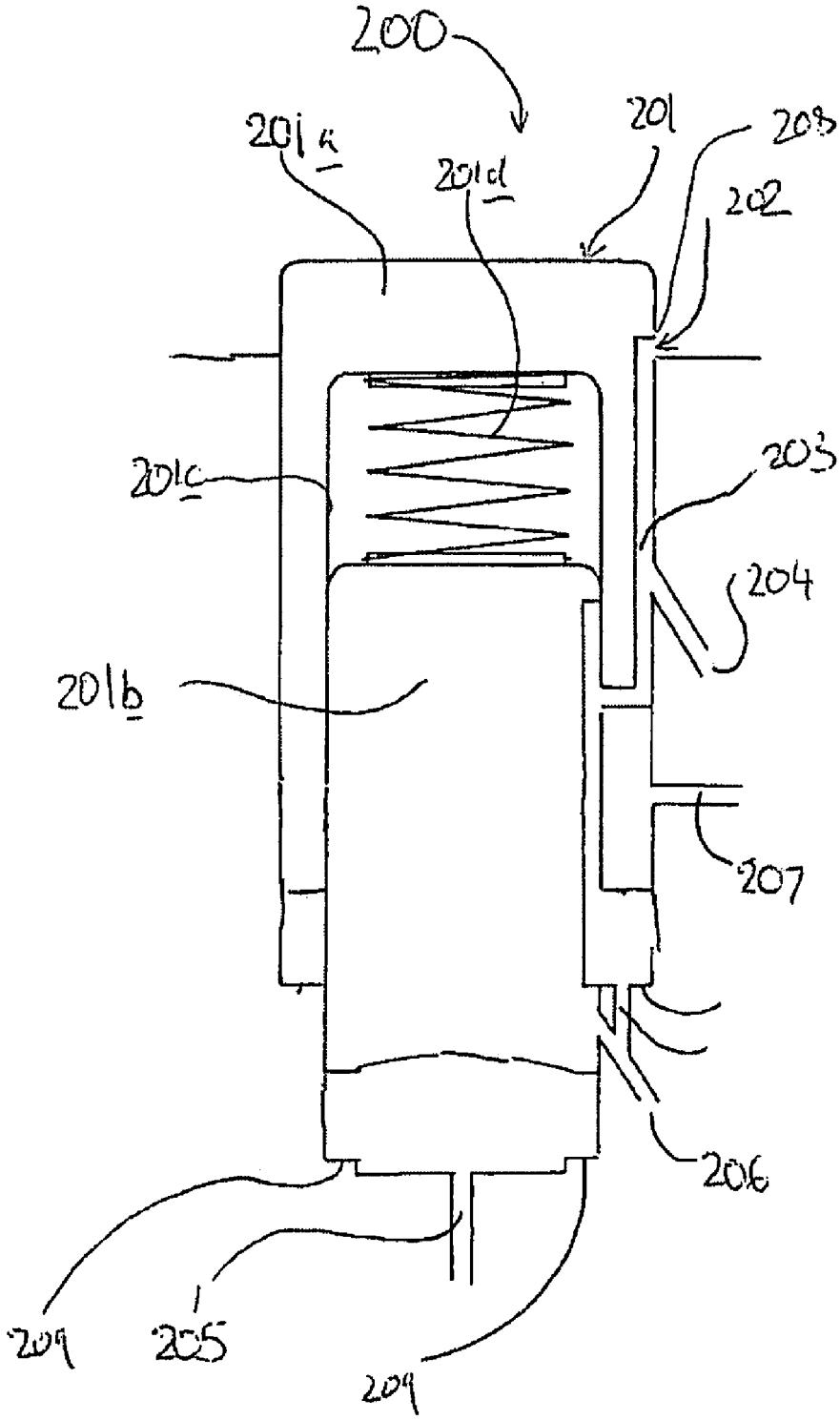
FIG. 19 is a sectional view through an alternative demand mechanism.

An alternative demand mechanism is shown at 200 in FIG. 19. The mechanism operates in a similar manner to the demand mechanism 25 of FIG. 18, but allows the channels to be moulded within the two parts of the button 201. A first button part 201*a* and second button part 201*b* are moveable within bore 201*c*, the first and second button parts being held apart by spring 201*d*. A vent to atmosphere is provided at 202 connected to channel 203 and an outlet to a first piston at 204. An outlet to a second piston is provided at 206. The part of the bore 201*c* below the second button part 201*b* is connected to the interior of the container through channel 205. Fluid under pressure is supplied on line 207.

When the first button part 201*a* is pressed, shoulder 208 closes the vent 202 and the outlet to the first piston 204 connected to the first piston, causing the operation of the valve element 26 as discussed above, where the valve element 26 rotates to its first position and allows the pressure within the container to fall to the second, lower pressure. As the pressure on line 207 falls, the force of spring 201*d* acts to push the second button part 201*b* downwards until it engages shoulders 209 at the end of the bore 201*c*. The outlet 206 is connected to pressure supply 207, causing the second piston to operate and the valve element 26 to rotate to the third, pouring position as discussed above.

When the button is 201 is released, outlets 204, 206 are vented to atmosphere, the valve element 26 returns to its first position and the container returns to a first pressure as discussed above.

Figure 20:
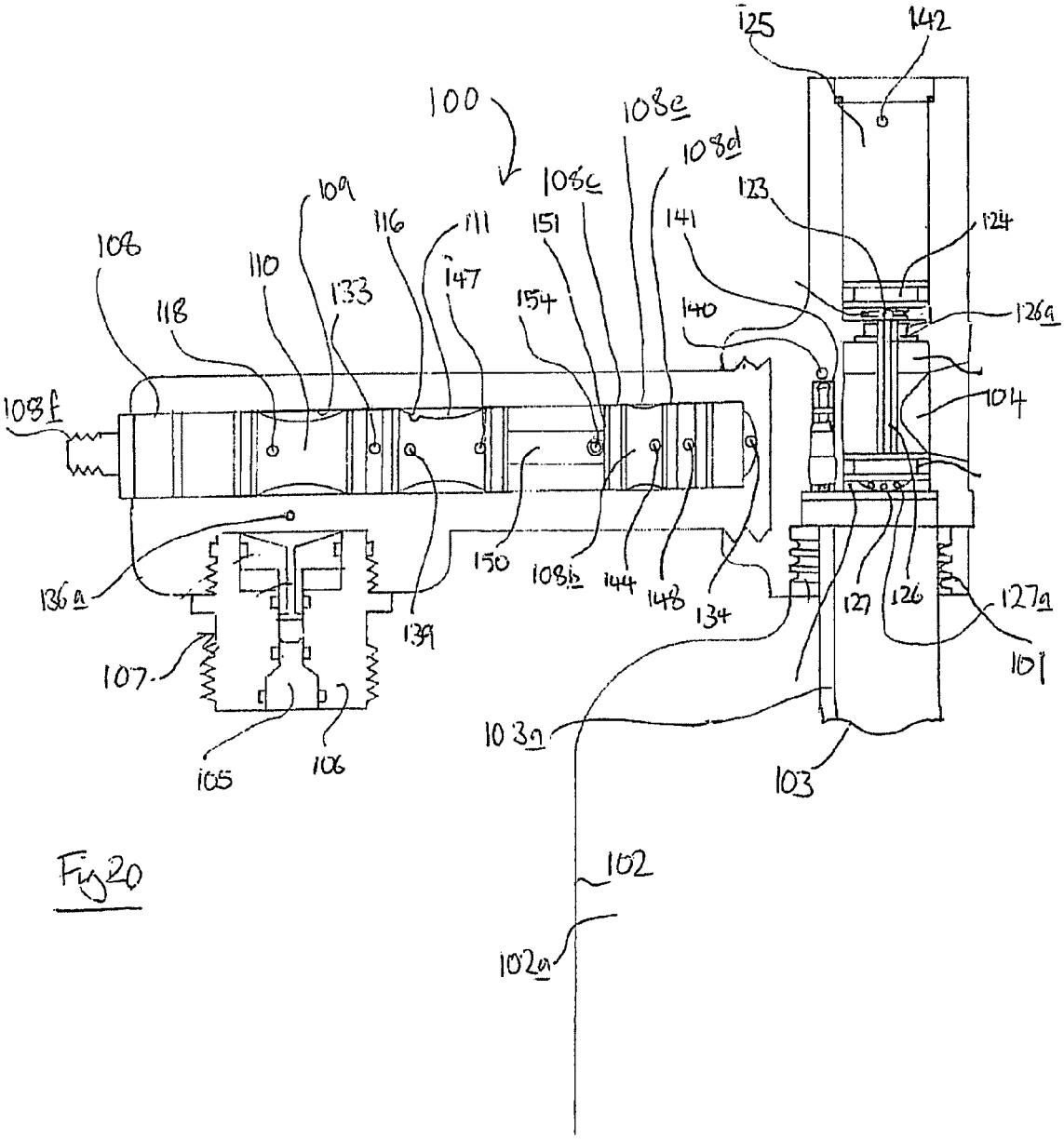
FIG. 20 is a sectional view through a further liquid dispenser embodying the present invention.

Referring now to FIG. 20, a further liquid dispenser embodying the present invention is shown at 100. As in the embodiment of FIGS. 1 to 19, the liquid dispenser 100 has a container engagement part 101 to provide a sealing engagement with a mouth part of a container 102 having a head space 102*a* above the liquid. An intake pipe 103 (shown cut away) extends into the container 102 and is connectable with an outlet chamber 104 as described in more detail hereafter to permit liquid to be expelled from the container 102 via a spout (not shown). In this example the intake pipe 103 is provided with a supply tube 103*a* which may be connected to the fluid pressure supply mechanism so that fluid under pressure is supplied through the liquid in the container 102, rather than into the head space 102*a*.

To supply pressurised fluid to the container 102, a pressure supply mechanism is shown here generally at 105. A nozzle 106 is provided to provide a threaded engagement with a supply of pressurised fluid, for example a gas canister not shown. The pressure supply mechanism has a regulator mechanism generally shown at 107, which is operable to supply pressurised gas from the pressurised fluid source to the valve mechanism at a desired pressure, for example 45 psi. The fluid pressure is supplied via a supply channel, illustrated at 136*a*.

To provide for control of the supply pressure to the contents of the container 102, a valve element 108 is provided which is slidably moveable within a bore 109, here shown in a first position. The valve element 108 is movable by applying pressure to the exposed end, for example to a button or other mechanism connected to the threaded support 108*f*.

As shown in FIGS. 21 to 23, the valve element 108 comprises a first part of reduced diameter 110 and a second part of reduced diameter 111. Adjacent these parts of reduced diameter, recesses 110*a*, 110*b*, 111*a*, 111*b* are provided to receive annular seals 112*a*, 112*b*, 113*b*, 113*b* as shown in FIG. 23, to provide a sealing, sliding fit with the interior face of the bore 109. The valve 108 is provided with two interior bores. First, as shown in FIG. 21, internal bore 114 extends between an outlet port 115 and a port 116 provided on the surface of the second part of reduced diameter 111. The second bore, shown in FIG. 22, extends from a port 117 to a port 118 provided in communication with the part of reduced diameter 110. The ports 115, 117 are disposed at an end part of the valve element 108, emerging in recesses 120, 121 respectively. The recesses 120, 121 receive a clip as shown in 122 in FIG. 24, essentially a sprung element which is resistant to passage of fluid under pressure from bores 115, 117, to provide a low pressure vent and high pressure vent respectively, in like manner to vents 40*a*, 41*a*. The strength of the clip 122 is selected to define the pressure at which fluid may be expelled from the respective port 115, 117, in the present example 7.5 psi from port 115 and 45 psi from port 117.

A second valve element 108*b* is disposed within the bore 109 and comprises a first seal 108*c* and second seal 108*d*, defining between them a part of reduced diameter 108*e*. A spacer 150 is provided slidably moveable within a bore 151 of the valve element 108, wherein the end part of the spacer 150 is attached to an end surface of the second valve element 108*b* or provided integrally therewith. The bore 151 is connected to bore 114.

To control the supply of liquid from the container 102, a supply mechanism is provided generally shown at 123. The supply mechanism 123 comprises a first piston 124 moveable within a chamber 125 and connected via rod 126 to a closer element comprising second piston 127 which is moveable within the outlet chamber 104. When the pistons 124, 127 are in their lower position as shown in FIG. 19, the outlet from the container 102 is closed and so no fluid can pass into the outlet chamber 104 and from then to an outlet. In the present example, rod 126 has an internal bore 126*a* connecting chamber 125 below the first piston 124 with outlet holes 127*a* in piston 127. These provide for additional fluid under pressure to be supplied to fluid being dispensed as it passes through outlet chamber 104, for example to carbonate liquids, but may be omitted if desired.

To permit the passage of pressurised fluid from the pressurised fluid supply 105, a first manifold 130 is provided as shown in FIG. 25 and a second manifold 131 is provided as shown in mirror-image view FIG. 26.

A first channel 132 within the first manifold 130 connects port 133, located between seals 112*b* and 113*a* of the valve element 108 when in the position shown in FIG. 19, a further port 134 disposed at the closed end of the bore 109, and a third port 135 disposed below the piston 127. The first channel 132 is connected to the fluid pressure source via supply channel 136*a* through an inlet port 136*b* and constriction 137.

The first manifold 130 has a second channel 138. The second channel 138 connects a first port 139 which is in flow communication with the bore, in connection with the space in the bore 109 defined by the second part of reduced diameter 111 of the valve element 108. A second port 140 is in flow communication with the interior of the container 102 through an inlet valve 141, whilst a third port 142 is in communication with the chamber 125 within which the piston 124 is moveable. A third channel 143 connects a port in flow communication with the bore 144 between the seals of the second valve element 108*b* and port 145 which is in flow communication with the chamber 125 below the piston 124 i.e. on the opposite side of the piston to port 142.

The second manifold 131 connects a first port 147 which is located in flow communication with the internal flow system bore 109 adjacent the second part of reduced diameter 111 of the valve element 109 and the port 148 connected to the internal bore 109 to the right of the second valve element 109*b* as shown in FIG. 20. The second manifold 131 is connected to the source of fluid pressure through channel 136*a* by port 136*c*.

The first manifold 130 also provides a vent to atmosphere 154, such that the space between the end of the valve element 108 and the second valve element 108*b* is vented to atmosphere.

In use, when a source of fluid pressure is connected to the nozzle 106 and a container 102 is connected, the valve element 108 will be in the position as shown. Fluid pressure is supplied though inlet 136*c* through the second manifold 131 to port 147. As this is in flow communication with a volume defined by the second part of reduced diameter III and the interior of the bore 109 pressure is then supplied through port 139 and the second channel 138 of the first manifold 130 to port 140 and through the valve 141 and in this example tube 103*a* into the contents of the container 102. Pressure is also supplied through port 142 to chamber 125, forcing the piston 124, 127 downwards to the closed position as shown in FIG. 20. Pressurised fluid is also supplied through the second manifold 131 to port 148, urging the second valve element 108*b* to the left as shown such that it abuts a pin or other stop (not shown), preventing it from moving further to the left. Should the pressure fall below the desired pressure, in this example 45 psi, the regulator 107 will supply more fluid under pressure from the fluid pressure source. The pressure within the bore 114 will act on the small end of the spacer 150. The pressure in the bore 109 to the right of the second valve element 108*b* will act on the end face of the second valve element 108*b*, and so the net force on the second valve element will act to urge it to the left as shown in FIG. 20.

When it is desired to dispense liquid from the container 102, the end part of the valve element 108 is pressed, causing the valve element 108 to move linearly within the bore 109 to a second position. The valve element 108 is moved to the right as shown in FIG. 20, but the balance of forces on valve element 108*b* means that it does not move to the right, but instead the spacer 150 moves within the bore 151. Ports 133 and 139 are first brought into flow communication with port 118 of the valve element 108. Via the second channel 138 of the first manifold 130, this connects the chamber 125, ports 135, 134 and 140, and hence the interior of bore 109 to the right of the second valve element 108*b* and the interior of the container, to the low pressure outlet 117. Pressure is thus vented until the pressure falls to the second lower pressure, in this example 7.5 psi.

The pressure within the bore 151 will remain at the higher pressure by virtue of port 116 remaining in flow communication with port 147. As the pressure acting on the larger face of the second valve element 108*b* falls, it will eventually be overcome by the pressure on the end of the spacer 150, urging the second valve element 108*b* to the right as shown in FIG. 20.

When the second valve element 108*b* moves to the right, the ports 148 and 144 are connected, thus supplying fluid at the first, higher pressure to the chamber 125 below the piston 124, forcing the piston 124 upwardly and lifting piston 127, thus opening the connection between the outlet chamber 104 and the container 102. As liquid is expelled from the container 102, the pressure in the head space is maintained by the fluid pressure connection through the first channel 132 of the first manifold 130 and port 135, at a reduced pressure due to the choke 137. When the liquid has been dispensed, the force on the end part 110 can be released. The first valve part 108 will be urged to the left by the pressure in the bore 114. The ports are connected as shown in FIG. 20, and the pistons 124, 127 urged to their closed position.

Figure 27:
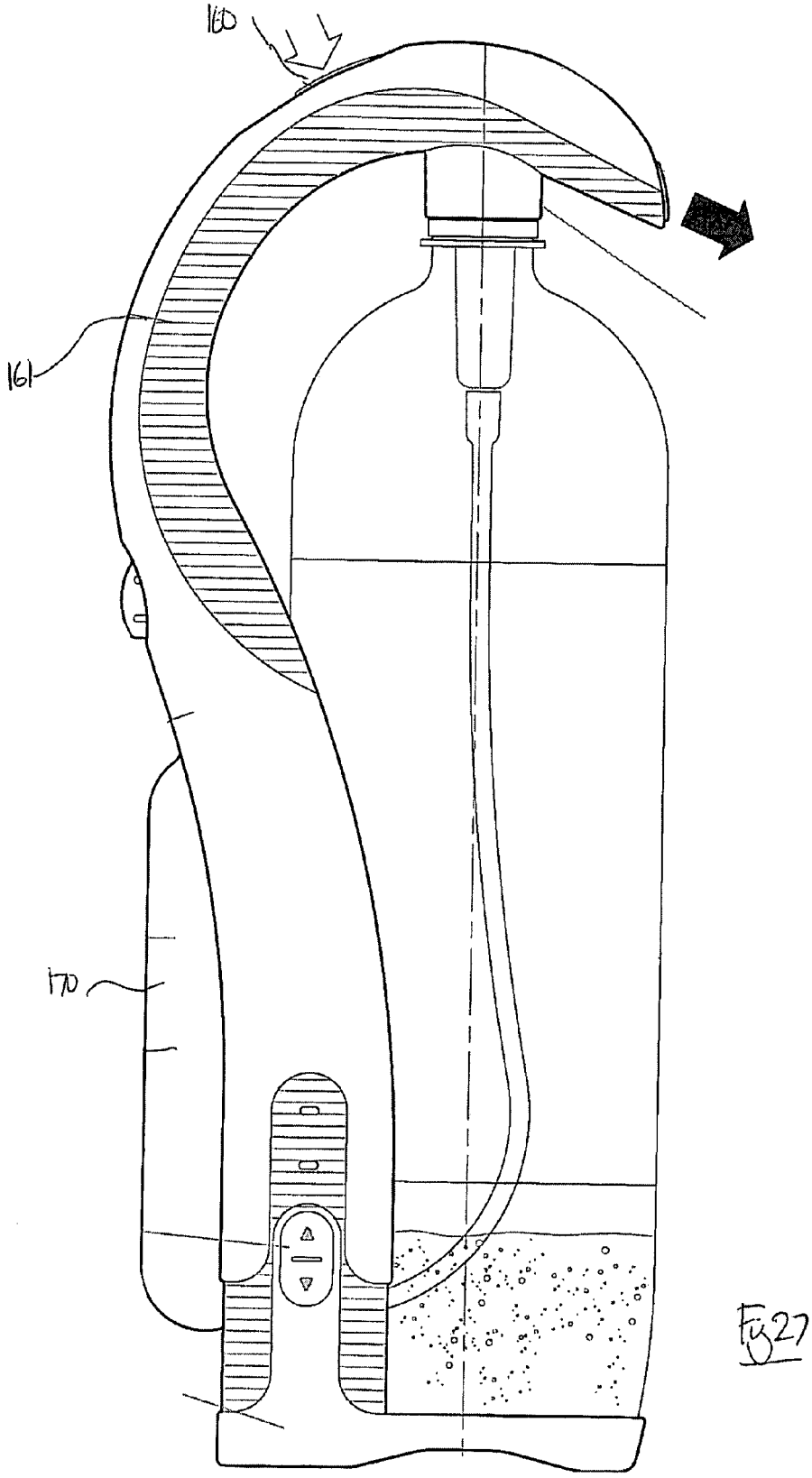
FIG. 27 is a side view of a further liquid dispenser.

It will be apparent that the end part 110 can be connected to any desirable control mechanism as desired. For example a side view of a possible liquid dispenser is shown in FIG. 27 with a dispensing button generally shown at 160 and a gas cylinder shown at 170 mounted in a handle 161 of the dispensing mechanism. It will be apparent that the embodiments of FIG. 1 and FIG. 20 may be included in any appropriate design of the liquid dispenser as desired.

A gas bottle connector is generally shown at 300 in FIGS. 28*a* to 28*d*. The connector 300 is suitable for use with either embodiment of the liquid dispenser, for example as shown at 300 in FIG. 20. The connector comprises an inlet 301 to which gas will be supplied by, for example, a gas bottle. A piston 302 is moveable within a first bore 303, its movement being constrained by an end 304 of the first bore 303 and a circlip 305. A second bore 306 having a smaller diameter than the first bore 303 extends from the first bore 303 to the inlet 301. A piston rod 307 is connected to the piston 302 and is slidably moveable within the second bore 306. A channel 308 extends from the upper face of the piston 302 through the piston rod 307 and has one or more ports 309. A upper o-ring seal 310 and a lower o-ring seal 311 provide a sliding seal between the piston rod 307 and the second bore 306. An upper part of the first bore 303 provides an outlet.

Figure 28A:
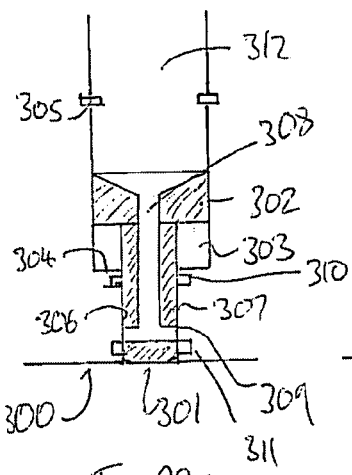
FIG. 28*a* is a sectional view of a connector for use with the liquid dispensers of FIG. 1 or FIG. 20 in a first position.
Figure 28B:
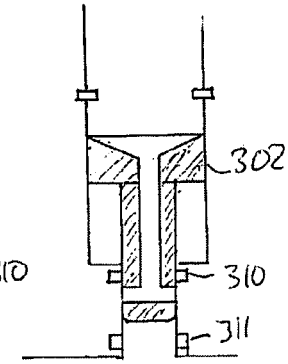
FIG. 28*b* is a sectional view of the connector of FIG. 28*a* in a second position

FIG. 28*a* shows the connector 300 in an equilibrium position, where the lower pressure in the liquid dispenser and hence in the bore 303 is balanced by the higher pressure in the gas container and applied to the smaller area of the end of the rod 307. When the pressure in the dispenser falls, as shown in FIG. 28*b* the piston 302 is forced upwards, moving the lower part of the piston rod 307 out of contact with the lower o-ring 311. As the tolerance between the rod 307 and the second bore 306 will not be exact, fluid under pressure will flow through the inlet 301, the ports 309 and channel 308 into the outlet 312. When the pressure has increased sufficiently, the piston 302 will return to the position of FIG. 28*a*.

Figure 28C:
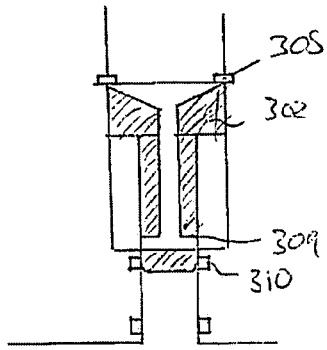
FIG. 28*c* is a sectional view of the connector of FIG. 28*a* in a third position

In the example of FIG. 28*c*, the pressure in the first bore 303 has been completely released, for example due to the connector 300 being deliberately removed from the dispenser, or due to a leak or otherwise. In this case, the pressure at inlet 301 will force the piston 302 upwards until it engages circlip 305 and the ports 309 are above the upper o-ring seal 310. No fluid under pressure can then pass from the inlet 301 to the outlet 312, and so the connector 300 is in a safe condition.

Figure 28D:
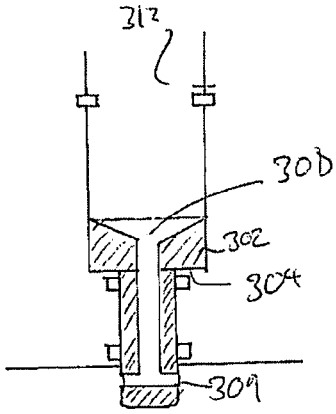
FIG. 28*d* is a sectional view of the connector of FIG. 28*a* in a fourth position.

The connector 300 can also be used to refill the gas container. As shown in FIG. 28*d*, pressure applied to the outlet 312 forces the piston 302 downwards until it engages the end 304 of the bore. The channel 308 and ports 309 provide a fluid connection allowing fluid under pressure to pass from the outlet 312 to the inlet 301.

Figure 28E:
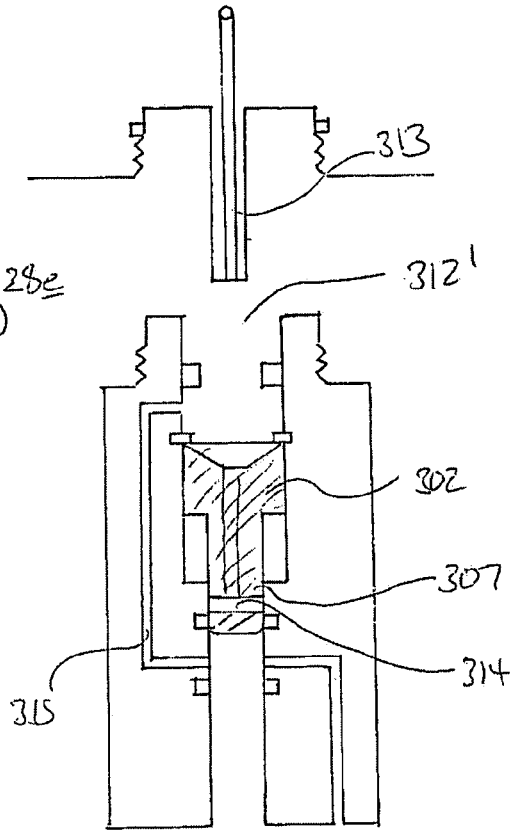
FIG. 28*e* is a sectional view of an alternative connector.

As shown in FIG. 28*e*, a push rod 313 can be provided on a device to which the connector 300 is attached, to displace the piston 302 from the closed position of FIG. 28*c* and allow pressure to pass from the inlet 301 to the outlet 312. FIG. 28*e* also shows an alternative piston 302' and rod 307' in which the rod 307' is solid apart from a through-bore 314, and movement of the piston 302' causes the throughbore 314 to open and close a supply channel 315 to supply fluid to an outlet 312'.

Accordingly, it will be apparent the liquid dispenser of the present invention allows liquid to be dispensed from a container without the liquid contents being exposed to atmosphere, with a sufficient pressure being maintained within the container to expel the liquid, but without an excessive pressure being maintained during dispensing which might cause the liquid to foam or otherwise be expelled abruptly. The valve element 26 allows the pressure to be maintained at a constant level even while liquid is being dispensed, and returned to the higher pressure level when no liquid is being dispensed. It will be apparent that this dispenser may be used for any appropriate liquid, such as a carbonated drink, where maintaining the pressure in the container at the higher level will prevent the drink going flat and by maintaining the wine under an inert, high pressure atmosphere will prevent oxidation and spoiling of the wine. Equally, it will be apparent, that the invention may be used for any other appropriate liquid as desired, and may be adapted to any desired container by providing a suitable container engagement part 16. In the embodiment described herein, it is envisaged that in the pressurised fluid comprises an inert gas such as nitrogen, but it might be envisaged that other gases or even liquid pressure might be used depending on the liquid to be dispensed.

It may be envisaged that, rather than dispensing liquid, the present invention may be used to dispense gases, foams, composite materials, or any suitable flowable material from a container.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realizing the invention in diverse forms thereof.

What is claimed is:

1. A fluid dispenser for dispensing fluid from a container, the fluid dispenser comprising: an intake pipe to receive fluid from the container, an outlet to dispense fluid, a pressure supply mechanism to supply pressurised fluid to the container at a first pressure, and a dispensing mechanism, the dispensing mechanism being operable to dispense fluid from the container by: reducing the pressure in the container to a second pressure, connecting the intake pipe to the outlet to dispense fluid from the container, and subsequently increasing the pressure in the container to the first pressure; wherein the dispensing mechanism comprises a valve element movable between a first position to connect to a head space of the container to the pressure supply mechanism, and a second position to connect the head space of the container to a vent to reduce the pressure in the head space of the container to the second pressure, and where the dispensing mechanism is further operable, when the intake pipe is connected to the outlet, to connect the head space of the container to the pressure mechanism supply to maintain the pressure in the head space in the container at about the second pressure while the fluid is dispensed, and wherein the valve element is movable to a third position to connect the pressure supply mechanism to the head space of the container via a restricter to maintain the pressure in the head space of the container at about the second pressure while fluid is being dispensed.

2. A fluid dispenser according to claim 1 wherein the dispensing mechanism is further operable, when the intake pipe is connected to the outlet, to connect a head space of the container to the pressure supply mechanism to maintain the pressure in the head space in the container at about the second pressure while the fluid is dispensed.

3. A fluid dispenser according to claim 1 wherein the valve element further comprises a fluid passage to connect the intake pipe to the outlet when the valve element is in its third position.

4. A fluid dispenser according to claim 1 wherein the valve element is rotatable between its positions.

5. A fluid dispenser according to claim 1 wherein the valve element is linearly moveable between its positions.

6. A fluid dispenser according to claim 1 comprising a closer element moveable to connect the intake pipe to the outlet when the valve element is in its second position.

7. A fluid dispenser according to claim 1 further comprising a biasing element to urge the valve element towards the first position.

8. A fluid dispenser according to claim 1 further comprising a demand mechanism operable to move the valve element from its first position.

9. A fluid dispenser according to claim 8 wherein the demand mechanism comprises a fluid pressure operated actuator, and a control operable to supply pressurized fluid to the actuator to move the valve element from its first position to its second position.

10. A fluid dispenser according to claim 9 wherein the demand mechanism is operable to move the valve element from the second position to the third position when the pressure in the head space of the container has reduced.

11. A fluid dispenser according to claim 10 wherein the demand mechanism comprises a secondary valve to connect the actuator to the pressure supply mechanism when the control is operated and the pressure in the head space of the container has fallen to the second pressure.

12. A fluid dispenser according to claim 10 wherein the actuator comprises a first actuation element to rotate the valve element from its first position to its second position when connected to the pressure supply mechanism, and a second actuation element to rotate the valve element to its third position when connected to the pressure supply mechanism.

13. A fluid dispenser according to claim 1 further comprising a fluid engagement part to engage a mouth of the container and to provide a pressure-tight seal therewith.

14. A fluid dispenser according to claim 1 comprising a pressure supply connector to connect to the pressure supply mechanism to a source of pressurized fluid.

15. A fluid dispenser according to claim 1 comprising a container having a first part having the pressure supply mechanism and a dispensing mechanism, and a second part to receive the container, the first part and second part being releasably connectable.

16. A fluid dispenser according to claim 1 in which the fluid is a liquid and the fluid dispenser is a liquid dispenser for dispensing a liquid from a container.

17. A fluid dispenser for dispensing fluid from a container, the fluid dispenser comprising:

an intake pipe to receive fluid from the container, an outlet to dispense fluid, a pressure supply mechanism to supply pressurized fluid to the container at a first pressure, and a dispensing mechanism including a valve movable between a first position, a second position and a third position, wherein:

in the first position a head space of the container connects to the pressure supply mechanism;

in the second position the head space of the container connects to a vent; and in the third position the intake pipe connects to the outlet, and the pressure supply mechanism connects to the head space of the container via a restricter.

* * * * *